US006933850B2

(12) United States Patent
Garcia et al.

(10) Patent No.: US 6,933,850 B2
(45) Date of Patent: Aug. 23, 2005

(54) FLUID PRODUCT DISTRIBUTION DEVICE AND DISTRIBUTOR COMPRISING SUCH A DEVICE

(75) Inventors: Firmin Garcia, Evreux (FR); Philippe Levillain, Le Neubourg (FR); Jean-Jacques Ligny, Evreux (FR)

(73) Assignee: Valois S.A.S., Le Neubourg (FR)

( * ) Notice: Subject to any disclaimer, the term of this patent is extended or adjusted under 35 U.S.C. 154(b) by 20 days.

(21) Appl. No.: 10/290,156

(22) Filed: Nov. 8, 2002

(65) Prior Publication Data

US 2003/0109068 A1 Jun. 12, 2003

Related U.S. Application Data

(60) Provisional application No. 60/342,397, filed on Dec. 27, 2001.

(30) Foreign Application Priority Data

Nov. 9, 2001 (FR) ..... 01 14724

(51) Int. Cl.[7] ..... G08B 13/14

(52) U.S. Cl. ..... 340/572.8; 128/200.14

(58) Field of Search ..... 340/572.1, 572.8, 340/693.5; 128/200.14, 200.23

(56) References Cited

U.S. PATENT DOCUMENTS 5,363,842 A * 11/1994 Mishelevich et al. .. 128/200.14

FOREIGN PATENT DOCUMENTS

| | | | | |
|---|---|---|---|---|
| DE | 201 05 605 U1 | | 6/2001 | |
| GB | 2 049 063 A | | 12/1980 | |
| JP | 200085864 | | 3/2000 | |
| WO | WO 9522365 A1 | * | 8/1995 | ..... A61M/15/00 |
| WO | WO 01/28887 A1 | | 4/2001 | |

* cited by examiner

*Primary Examiner*—Thomas Mullen
(74) *Attorney, Agent, or Firm*—Sughrue Mion, PLLC

(57) ABSTRACT

A fluid product distribution device (1) having a body (10) defining an entry passage (11), an actuating rod (13) displaceable in the body, an actuating element (15) coupled to the actuating rod, and a fixation element (17) for fixing the body (10) in an opening (20) of a receptacle (2) containing fluid product. One of the components is provided with an identification unit (3) suitable for delivering information relating to the distribution device.

16 Claims, 3 Drawing Sheets

FLUID PRODUCT DISTRIBUTION DEVICE AND DISTRIBUTOR COMPRISING SUCH A DEVICE

CROSS REFERENCE TO RELATED APPLICATION

This application claims the benefit under 35 U.S.C. §119 (e) of pending U.S. provisional patent application Ser. No. 60/342,397, filed Dec. 27, 2001, and priority under 35 U.S.C. §119(a)–(d) of French patent application No. FR-01.14724, filed Nov. 9, 2001.

BACKGROUND OF THE INVENTION

The present invention relates to a device for fluid product distribution comprising a body defining an entry duct, an actuating rod displaceable within the body, an actuating device coupled to the actuating rod, and fixation element for fixing the body in an opening of a recipient containing the fluid product. The above is a classic or conventional concept for a pump or a valve used in the domain of perfumery, cosmetics or pharmacies to distribute fluid products contained in recipients such as flasks, bottles, etc.

More particularly, the present invention relates to the capacity of authentication as well as traceability of the distribution device or more generally the distributor using such a distribution device. In fact it is important to be able to identify without any possible doubt the origin of the distribution device in order to be able to distinguish rapidly and easily between an authentic and an imitation or forgery. More particularly, for traceability, it is important to be able to follow the track or the path of the distribution device from its manufacture to its sale or its offer for sale.

For a long time it has been known how to use distinctive marks or signs set on or integrated into the distributor or distribution device in order to identify visually the product origin. However, it is very easy for a forger to imitate this mark or distinctive sign and to put it on counterfeit distributors.

BRIEF SUMMARY OF THE INVENTION

The aim of the present invention is to remedy this above-mentioned inconvenience of prior art by defining a new means of identification which is practically unfalsifiable for a distribution device or a distributor using such a device.

In order to achieve this aim, the present invention envisages that one of the constitutive components of the distribution device should be provided with an identification unit capable of delivering information relative to the distribution device. Advantageously, the identification unit comprises an integrated circuit and an aerial able to emit signals carrying information. The signals can, for example, be of the radio-frequency type. The identification unit is thus able to deliver information under the form of a signal in response to an emitter signal requesting information received by the unit's aerial.

According to one embodiment of the invention, the identification unit is set in a support integral with the body. Advantageously, the support forms a ring engaged around the body.

According to another embodiment, the identification unit is embarked in the actuating device. Advantageously, the actuating device is a push button mounted on the actuating rod.

According to another embodiment, the identification unit is set in the fixation means.

The identification unit can be fixed to the constitutive components of the distribution device, or as a variant it can be encapsulated or embedded in the material forming the component.

The invention also relates to a fluid product distributor such as a vaporiser comprising a recipient and a distribution device according to the invention.

BRIEF DESCRIPTION OF THE DRAWINGS

The invention will now be described in more detail with reference to the attached drawings giving several embodiments of the invention, as non-limiting examples.

In the figures.

DETAILED DESCRIPTION OF THE PRESENT INVENTION

Figure 1:
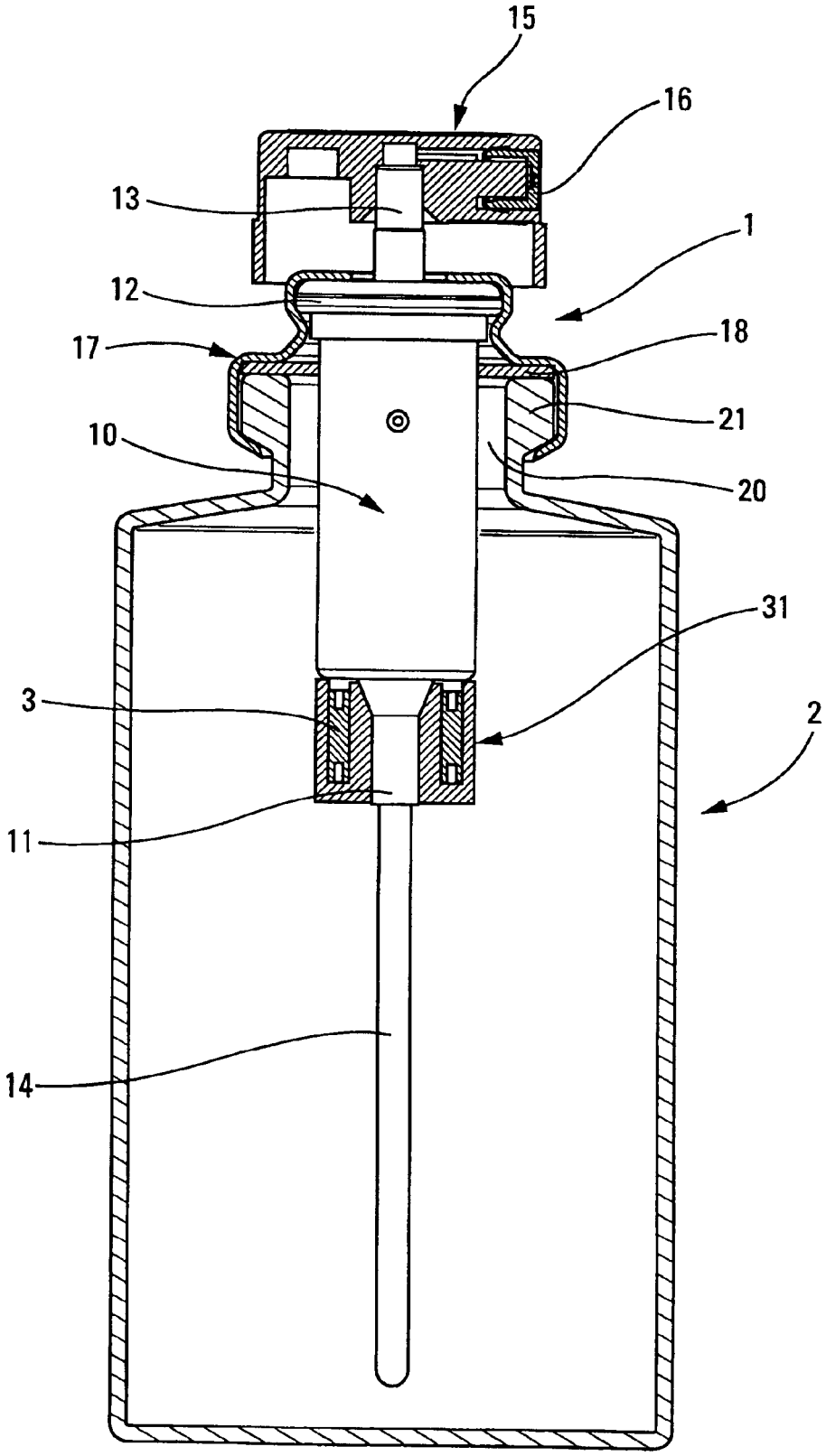
FIG. 1 is a partial view of a vertical cross-section through a fluid product distributor provided with a distribution device according to a first embodiment of the invention.

The present invention applies to all distribution devices such as pumps or valves. Consequently, the distribution device 1 shown in the figures can be either a pump or a valve, as chosen. The distribution device 1 comprises all the components needed for assembling it on a recipient (i.e., receptacle or container) 2. For this purpose, the recipient 2 comprises a neck 21 defining an opening 20 through which the interior of the recipient 2 communicates with the exterior.

The distribution device 1 comprises a body 10 defining an entrance sleeve 11 to which a dip tube 14 can be connected, extending inside the recipient 2 as far as the level of its base. At its extremity opposite the entry sleeve 11, the body 10 comprises a little neck ring 12 which juts out outside. The distribution device also comprises an actuating rod or shaft 13 which is mounted to be displaceable transversally inside the body 10. This actuating rod 13 drives an element (not visible) which can be a piston in the case of a pump or a valve in the case of a delivery valve. But this is not critical for the present invention. An actuating element 15 in the form of a push button is mounted at the upper extremity of the actuating rod 13. In the example shown, the push button 15 forms the distribution orifice 16, for example in the form of a spray. The operation of such a distribution device is very simple and well known; it suffices to press on the button 15 to displace the actuating rod 13 into the body 10 which has the effect of distributing a quantity of fluid product, measured or not, through the actuating rod 13 as far as the distribution orifice 16. All this is completely classic for a pump or a valve in the domain of cosmetics, perfumery or pharmaceuticals.

In order to fix the body 10 in the opening 20 of the recipient 2, fixation element or means 17 are envisaged which in this case are in the form of a cup to be crimped. This cup 17 forms a housing to receive the neck ring 12 of the body 10 and also forms a crimping around the neck 21. This is an example of a non-limiting embodiment, since these fixation element can also be in the form of a ring or a little turret made for example out of plastic material which is engaged on the inside or on the outside of the neck and which also forms a housing to receive the neck ring 12 of the body 10. Here again, the actual shape of the means of fixation is not critical for the present invention.

In order to produce a sealed fixation in the opening 20, the means of fixation 17 advantageously comprise a neck join (i.e., gasket or seal) 18 intended to be compressed at the upper extremity of the neck 21. This concerns a completely classic description of a pump or valve.

According to the invention, the distribution device further comprises an identification unit capable of delivering one or several pieces of information relative to the distribution device. The information delivered by the identification unit can be of various natures: it can for example involve information about the properties of the distribution device itself, its date and place of manufacture, its destination, its dispatch date, its date and place of reception etc. The information can for example be transmitted from the identification unit by radio-frequency. In this case, the identification unit can comprise an integrated circuit 301 associated with an aerial 302, the whole embedded or encapsulated in a resin mass 303 or any other appropriate material. This can be seen in FIG. 5. Here it concerns an example of a known embodiment for an identification unit of the radio-frequency type. The integrated circuit stores the information arriving from an information emitter unit and received by the aerial 302. In order to output or deliver the information stored by the integrated circuit 301, one can also use an emitter unit which sends a signal requesting information, and received by the aerial 302, and in response to this signal requesting information, the integrated circuit 301 will output the stored information through the intermediary of the aerial 302.

The utilisation of such a radio-frequency identification unit is evidently only one example of embodiment, and it can by understood that it is possible to use any type of identification unit which can operate with another information transmission technique.

With reference to FIG. 1, it can be seen that the entry sleeve 11 is provided with a ring 31 which acts as support for the identification unit 3. The ring 31 can simply be fixed on the entry sleeve 11 by force until it comes up against a stop. The identification unit 3 can simply be housed or placed in the support ring 31 or, as a variant, the identification unit 3 can be encapsulated or embedded in the mass constituting the support ring 31.

This is a preferred embodiment, because the identification unit is not surrounded by any metal, able to disturb the operation of the antenna. Moreover, the unit is protected inside the reservoir. To remove it, the dispenser should be destroyed.

Figure 2:
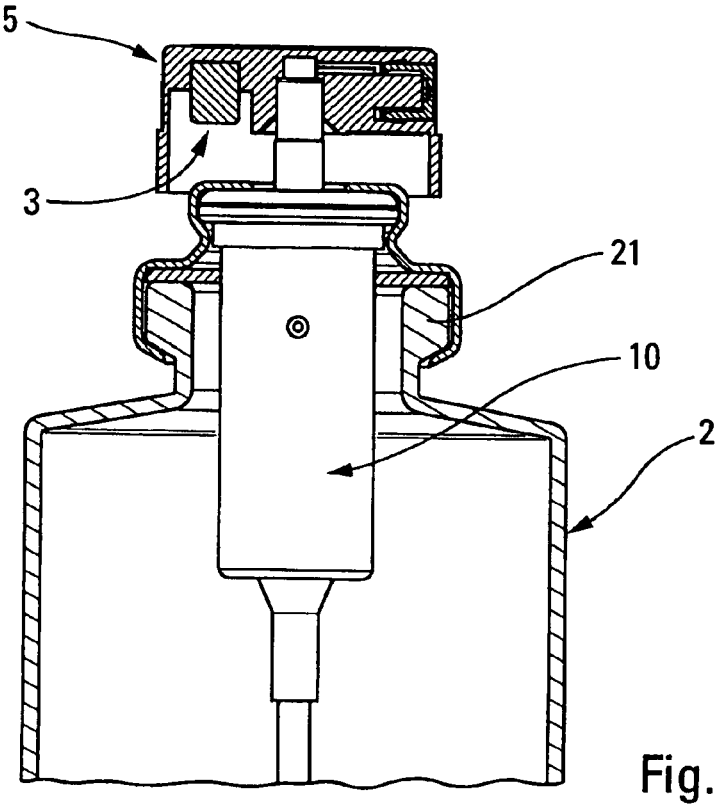
FIG. 2 is a shortened view similar to FIG. 1 showing a second embodiment of the distribution device according to the invention.

With reference to FIG. 2, it can be seen that the identification unit 3 is housed in the push button 15 which forms a housing capable of receiving the identification unit 3. However, one can imagine that the identification unit 3 can be embedded or encapsulated in the constitutive material, in this case the plastic material, of the push button 15. In this case, the resin mass 303 is literally replaced by the plastic material constituting the push button 15. In the case where the push button is provided with an overcapsule, for example in metal, the identification unit can be placed and maintained on the overcapsule.

Figure 3:
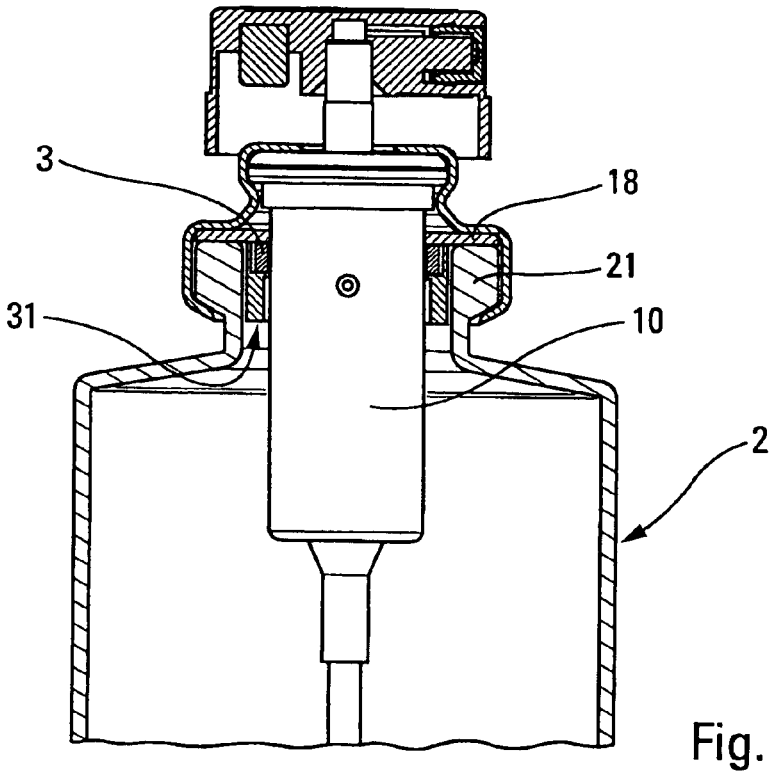
FIG. 3 is a view similar to FIG. 2 showing a third embodiment of the distribution device according to the invention.

With reference to FIG. 3, it can be seen that the identification unit 3 is supported by a ring 31 engaged around the body 10 just in the opening 20 under the join 18. This is a variant of the embodiment of FIG. 1, and the identification unit 3 can simply be placed or even embedded in the support ring 31.

Figures 4, 5:
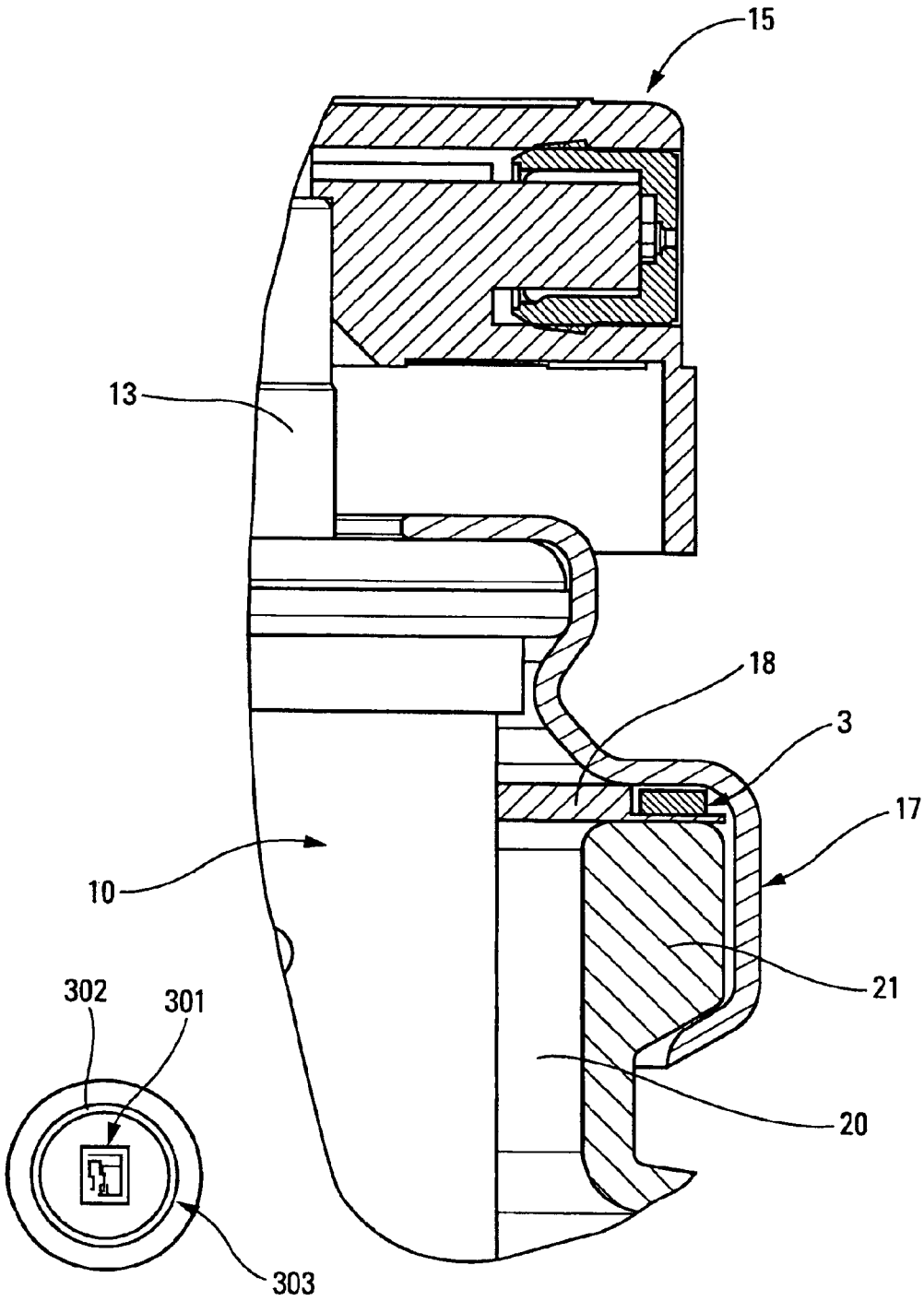
FIG. 4 is a greatly expanded view of part of a distributor using a distribution device according to a fourth embodiment of the invention.
FIG. 5 is a diagrammatic view showing an embodiment of an example of a radio-frequency identification unit.

With reference to FIG. 4, it can be seen that the identification unit 3 is mounted on the neck join 18 which has a recess in it for receiving the identification unit 3.

Evidently one can imagine other setting places for such an identification unit 3. For example, one can place the identification unit in the body 10 or even in the constitutive side wall of the body 10 by an encapsulating or embedding method.

With the invention, the identification unit 3 really becomes an integral part of the distribution device in such a way that it is undissociable from it.

What is claimed is:

1. Fluid product distribution device (1) comprising the following components:

a body (10) defining an entry passage (11), an actuating rod (13) displaceable in the body, an actuating element (15) coupled to the actuating rod, and fixation element (17) for fixing the body (10) in an opening (20) of a receptacle (2) containing fluid product, wherein one of the components is provided with an identification unit (3) structured to deliver information relating to the distribution device, and wherein the identification unit extends around the body (10).

2. Distribution device according to claim 1, in which the identification unit (3) comprises an integrated circuit (301) and an aerial (302) capable of emitting signals carrying information.

3. Distribution device according to claim 1, in which the identification unit (3) is encapsulated or embedded in a resin mass.

4. Fluid product distributor comprising a recipient (2) and a distribution device (1) according to claim 1.

5. Fluid product distributor according to claim 4, in which the recipient (2) comprises a neck (21), the body is engaged in said neck, and the identification unit is located between the body and the neck.

6. Distribution device according to claim 1, wherein the identification unit (3) is mounted in a support and wherein the support forms a ring (31) engaged around the body (10).

7. Distribution device according to claim 1, in which the body (10) defines an entrance sleeve (11), the identification unit extends around said sleeve.

8. The distribution device according to claim 1, in which the identification unit (3) is mounted in a support (31).

9. The distribution device according to claim 8, in which the support is engaged around the body (10).

10. The distribution device according to claim 1, in which the identification unit comprises electronic circuitry.

11. The distribution device according to claim 10, in which the electronic circuitry comprises an integrated circuit and an aerial that transmit or receive radio signals.

12. The distribution device according to claim 1, wherein the distribution device is one of a pump or valve.

13. Fluid product distribution device (1) comprising the following components:

a body (10) defining an entry passage (11), an actuating rod (13) displaceable in the body, an actuating element (15) coupled to the actuating rod, and fixation clement (17) for fixing the body (10) in an opening (20) of a receptacle (2) containing fluid product, wherein one of the components is provided with an identification unit (3) structured to deliver information relating to the distribution device, and wherein the identification unit (3) is mounted in a support (31) integral with the body (10).

14. Distribution device according to claim 13, in which the support forms a ring (31) engaged around the body (10).

15. The distribution device according to claim 13, in which the identification unit comprises electronic circuitry.

16. The distribution device according to claim 15, in which the electronic circuitry comprises an integrated circuit and an aerial that transmit or receive radio signals.

* * * * *